US009549617B1

(12) United States Patent
Deluca

(10) Patent No.: US 9,549,617 B1
(45) Date of Patent: Jan. 24, 2017

(54) CHAIR BACK COOLER

(71) Applicant: AXIS SOURCING GROUP, INC., Concord, CA (US)

(72) Inventor: Alisha Haskell Deluca, Concord, CA (US)

(73) Assignee: AXIS Sourcing Group, Inc., Concord, CA (US)

( * ) Notice: Subject to any disclaimer, the term of this patent is extended or adjusted under 35 U.S.C. 154(b) by 0 days.

(21) Appl. No.: 15/130,925

(22) Filed: Apr. 15, 2016

Related U.S. Application Data

(60) Provisional application No. 62/150,050, filed on Apr. 20, 2015.

(51) Int. Cl.
*A47C 31/00* (2006.01)
*A47C 7/74* (2006.01)
*A47C 7/40* (2006.01)

(52) U.S. Cl.
CPC *A47C 7/746* (2013.01); *A47C 7/40* (2013.01)

(58) Field of Classification Search
CPC ..... A47C 7/746; A47C 7/40
USPC .... 297/180.11, 180.1, 219.1, 228.12, 228.13
See application file for complete search history.

(56) References Cited

U.S. PATENT DOCUMENTS 5,833,309 A * 11/1998 Schmitz ..... A47C 7/74 297/180.11
5,971,947 A * 10/1999 McNally ..... A61F 13/108 602/14
6,132,455 A * 10/2000 Shang ..... A47C 7/744 5/654
6,440,159 B1 * 8/2002 Edwards ..... A61F 7/02 607/108
6,848,746 B2 * 2/2005 Gentry ..... A47C 7/748 297/180.11
D513,146 S * 12/2005 Griffin ..... D6/611
7,097,244 B2 * 8/2006 Holmgren ..... B60N 2/56 297/219.12
7,156,465 B2 * 1/2007 Stewart, III ..... A47C 7/021 297/230.1
7,517,013 B1 * 4/2009 Lowe ..... A47C 7/742 297/180.11
7,744,153 B2 * 6/2010 Gentry ..... A47C 7/46 297/180.1
8,556,337 B1 * 10/2013 Cornitius-Cary ..... A47C 7/021 224/275

(Continued)

*Primary Examiner* — Laurie K Cranmer
(74) *Attorney, Agent, or Firm* — Charles L. Thoeming

(57) ABSTRACT

A seat back or chair cooling apparatus that cools the back of a user without the need of forced air. The cooling apparatus includes a pocket having an open end and three closed or closable sides. At least one gel pack embodiment is configured to be inserted into the pocket open end. An adjustable belt, housed in a belt pocket and attached to the pocket sides, is deployed to affix the back cooler assembly to a chair back. Hook straps and hooks provide additional attachment points to secure the back cooler assembly to a chair back, and these straps and hooks have separate hook strap and hook storage pockets within the cooling pocket. The cooling pocket can include polyester, fabric or olefin materials, and can also include a mesh backside. Embodiments of the pocket closures in the portable seat or chair back cooler include metal-magnetic button fasteners, button and button-hole fasteners, or Velcro™ hook and loop fasteners.

16 Claims, 10 Drawing Sheets

(56) References Cited

U.S. PATENT DOCUMENTS

| | | | | |
|---|---|---|---|---|
| 8,870,281 | B1 * | 10/2014 | Boone | A47C 7/746 297/180.1 |
| 8,950,807 | B2 * | 2/2015 | Lerm | A47C 7/744 297/188.15 |
| 8,979,192 | B2 * | 3/2015 | Miller | A47C 4/286 297/180.12 |
| 9,072,365 | B1 * | 7/2015 | Maneii | A45F 3/02 |
| 9,074,793 | B1 * | 7/2015 | Baureis | F24J 3/00 |
| D742,533 | S * | 11/2015 | Kang | D24/207 |
| 9,221,372 | B1 * | 12/2015 | Lacey | B60N 2/60 |
| 9,259,091 | B2 * | 2/2016 | Freund | A47C 7/383 |
| 9,271,575 | B1 * | 3/2016 | Leff | A47C 7/42 |
| 2002/0052566 | A1 * | 5/2002 | Sequeira | A61F 7/02 601/112 |
| 2004/0075311 | A1 * | 4/2004 | Linder | A47C 7/74 297/188.04 |
| 2007/0236074 | A1 * | 10/2007 | Rodriquez, Jr. | A47C 7/021 297/452.41 |
| 2008/0136231 | A1 * | 6/2008 | Doherty | B60N 2/2881 297/219.12 |
| 2009/0127895 | A1 * | 5/2009 | Gentry | A47C 7/46 297/180.11 |
| 2010/0059199 | A1 * | 3/2010 | Court | A47C 7/742 165/46 |
| 2011/0248532 | A1 * | 10/2011 | Kim | A47C 7/748 297/180.11 |
| 2012/0187732 | A1 * | 7/2012 | Lerm | A47C 7/744 297/219.12 |
| 2013/0247828 | A1 * | 9/2013 | Tedaldi | A01K 1/0353 119/28.5 |

* cited by examiner

CHAIR BACK COOLER

CROSS-REFERENCES TO RELATED APPLICATIONS

This U.S. non-provisional patent application is based upon and claims the filing date of U.S. provisional patent application Ser. No. 62/150,050 filed Apr. 20, 2015.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BT-REFERENCE OF MATERIAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable.

STATEMENT REGARDING COPYRIGHTS/TRADEMARKS

Portions of the disclosure of this patent document contain material which is subject to copyright/trademark protection. The copyright/trademark owner has no objection to the facsimile reproduction by anyone of the patent document or the patent disclosure, as it appears in the United States Patent and Trademark Office patent file or records, but otherwise reserves all copyright and trademark rights whatsoever.

BACKGROUND OF THE INVENTION

Field of the Invention

The invention pertains to a portable seat back cooling apparatus.

DESCRIPTION OF RELATED ART INCLUDING INFORMATION DISCLOSED UNDER 37 CFR 1.97 and 1.98.

Not Applicable.

BACKGROUND OF THE INVENTION

Many have experienced the discomfort of sitting against the seat of a vehicle or chair in hot weather. In this context, air conditioning is initially irrelevant to the problem. This is because the sun has had a long time to heat the seat or chair; the air conditioning has had little time to cool it off, and once we sit cool air cannot flow between the seat and our back to carry away the heat. Some deal with the problem by not sitting back until the seat cools off. Others have tried to solve the problem with a bit more sophistication by providing seat coolers using forced convection; however, forced convection seat coolers add complexity. For example, if a battery powered pump provides the forced air stream, the system requires a battery, a pump, and a system for charging the battery, etc. If existing vehicle ventilation provides the forced air, the system requires hose(s) and attachments to connect to the seat cooler to the existing vehicle ventilation. In addition, using the existing ventilation will reduce the air delivered to other parts of the vehicle. Forced convection seat coolers have also used small openings that clog with dust over time reducing cooling efficiency until the user cleans the openings. This is tedious and time consuming and some may discard the seat cooler at this point. Forced air seat coolers are left in the vehicle even when not needed to save the time required to connect the components, which get in the way.

Fabric seat covers are also inadequate because they rely on cooling arising from bellowing when a person shifts in the seat. However, trapped hot air in the fabric tends to stay trapped and movement required to generate the cooling may not occur. The fabric may even build up heat due to the fabric's insulating properties. It would be desirable if a seat or chair back cooler could address these problems, and cool without the need for forced ventilation and the accessories mentioned earlier.

Accordingly, there is a need for a portable seat or chair back cooler that is adaptable to existing automobile seats as well as a wide range of chairs.

There is further need for a portable seat or chair back cooler that can be fitted onto an automobile seat or a chair to provide cooling comfort for a person sitting in the seat or chair.

There is yet a further need for a portable seat or chair back cooler that can be fitted onto an automobile seat or a chair to provide without the requirements of any external cooling assembly or power.

There is also a need for a portable seat or chair back cooler that can be fitted onto an automobile seat back or a chair back using either a separate adjustable belt or an adjustable belt —hook and strap combination for increased stability of the back cooler position on the automobile seat back or chair back.

Yet another need is for a portable seat or chair back cooler that can be safely fitted onto an automobile seat or a chair that can be easily and inexpensively manufactured, and easily used.

BRIEF SUMMARY OF THE INVENTION

Embodiments of a portable seat or chair back cooler are provided that include a pocket having an open end and three closed or closable sides. At least one gel pack embodiment is configured to be inserted into the pocket open end. An adjustable belt is housed in a belt pocket, and can be deployed to affix the back cooler assembly to a chair back. Hook straps and hooks provide additional attachment points to secure the back cooler assembly to a chair back, and these straps and hooks have separate hook strap and hook storage pockets within the cooling pocket assembly. The cooling pocket assembly can include polyester, fabric or olefin materials, and can also include a mesh backside. Pocket closures in the portable seat or chair back cooler can include magnetic or traditional buttons or Velcro™ hook and loop fasteners.

Other features, advantages, and objects of the portable seat or chair back cooler will become apparent with reference to the following description and accompanying drawings.

BRIEF DESCRIPTION OF THE SEVERAL VIEWS OF THE DRAWINGS

These and other features, aspects, and advantages of embodiments of the chair back cooler will become better understood with regard to the following description, appended claims, and accompanying drawings as further described.

DETAILED DESCRIPTION OF THE INVENTION

Embodiments the apparatus for the chair back cooler 10 are illustrated and disclosed in FIGS. 1-11.

Figure 1:
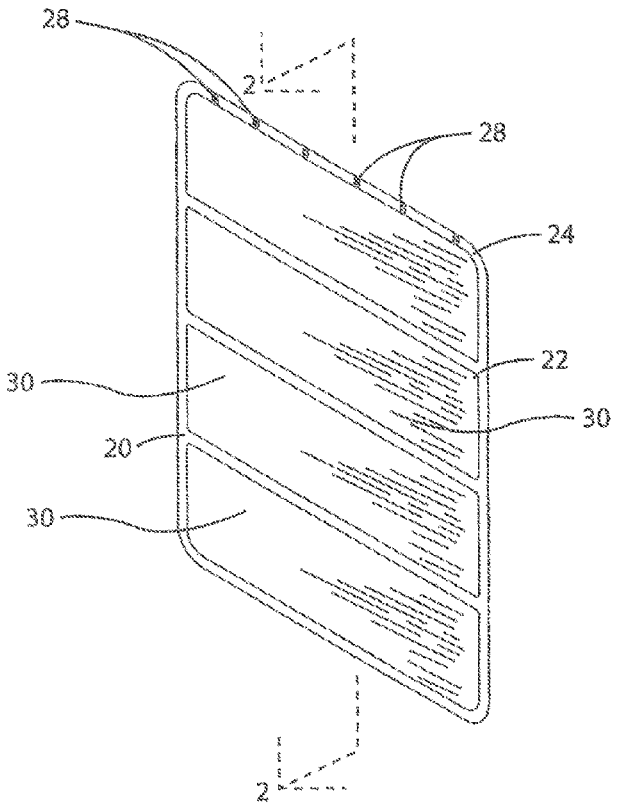
FIG. 1 is as front top right perspective view of a gel pack insert 20 for an embodiment of the chair back cooler having a four similar sized rectangular gel packs 30 horizontally arranged on a gel pack front side 22 and a plurality of gel pack buttons 28 disposed along a pack front top surface 24.
Figure 2:
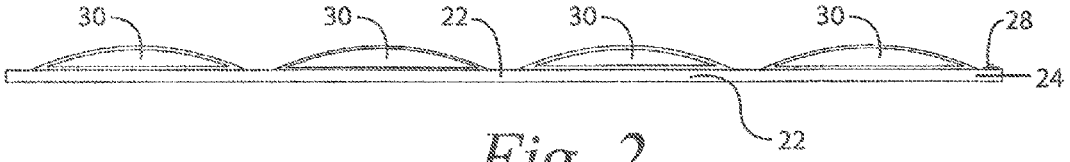
FIG. 2 is a cross sectional view of FIG. 1 taken at "2-2."

An embodiment of a chair back cooler 10 includes an gel pack insert 20 having a four similar sized rectangular gel packs 30 horizontally arranged on an gel pack front side 22 and a plurality of gel pack buttons 28 disposed along an gel pack front top surface 24, FIGS. 1 and 2. It will be understood by persons having ordinary skill in the associated art, that the gel pack insert 20 for an embodiment of a chair back cooler 10 may include a variety of gel packs in various geometric configurations to optimize the cooling effect of the chair back cooler 10 over a wide range of applications.

Figure 3:
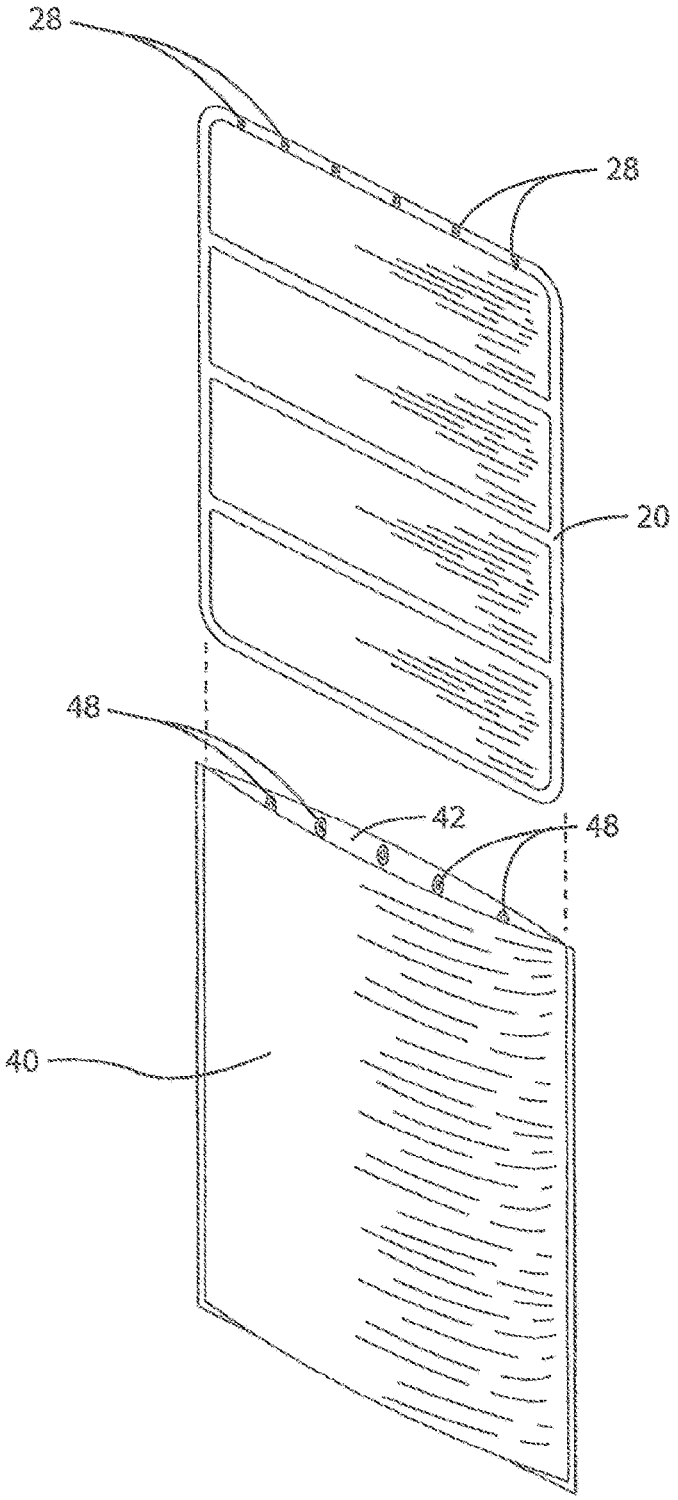
FIG. 3 is a front top right perspective view of a gel pack insert 20 for an embodiment of the chair back cooler positioned to be placed into a pocket 40 top open end 42 and received by the pocket 40, and where a plurality of pocket buttons 48 are configured to correspond to the plurality of gel pack buttons 28 to hold the gel pack in proper vertical position once the gel pack 20 is fully inserted into the pocket 40.

The gel pack insert 20 for an embodiment of the chair back cooler 10 is suitably sized to be positioned and placed into a pocket 40 top open end 42 and received by the pocket 40, FIG. 3. The gel pack 20 can be any of the reusable hot/cold gel packs currently known in the art. A plurality of pocket buttons 48 are configured to correspond to the plurality of gel pack buttons 28 to hold the gel pack in proper vertical position once the gel pack 20 is fully inserted into the pocket 40.

Embodiments of the back cooler 10 provide polyester, fabric or olefin pocket 40 materials, and it will be understood by persons having ordinary skill in the associated art, that the pocket 40 for an embodiment of a chair back cooler 10 may include a mesh back surface. It will be further understood by persons having ordinary skill in the associated art, that the pocket 40 for an embodiment of a chair back cooler 10 may include Velcro™ hook and loop fasteners, buttons or stitching to close the three closed or closable sides of the pocket 40 to optimize the utility of the chair back cooler 10 over a wide range of applications.

Figure 4:
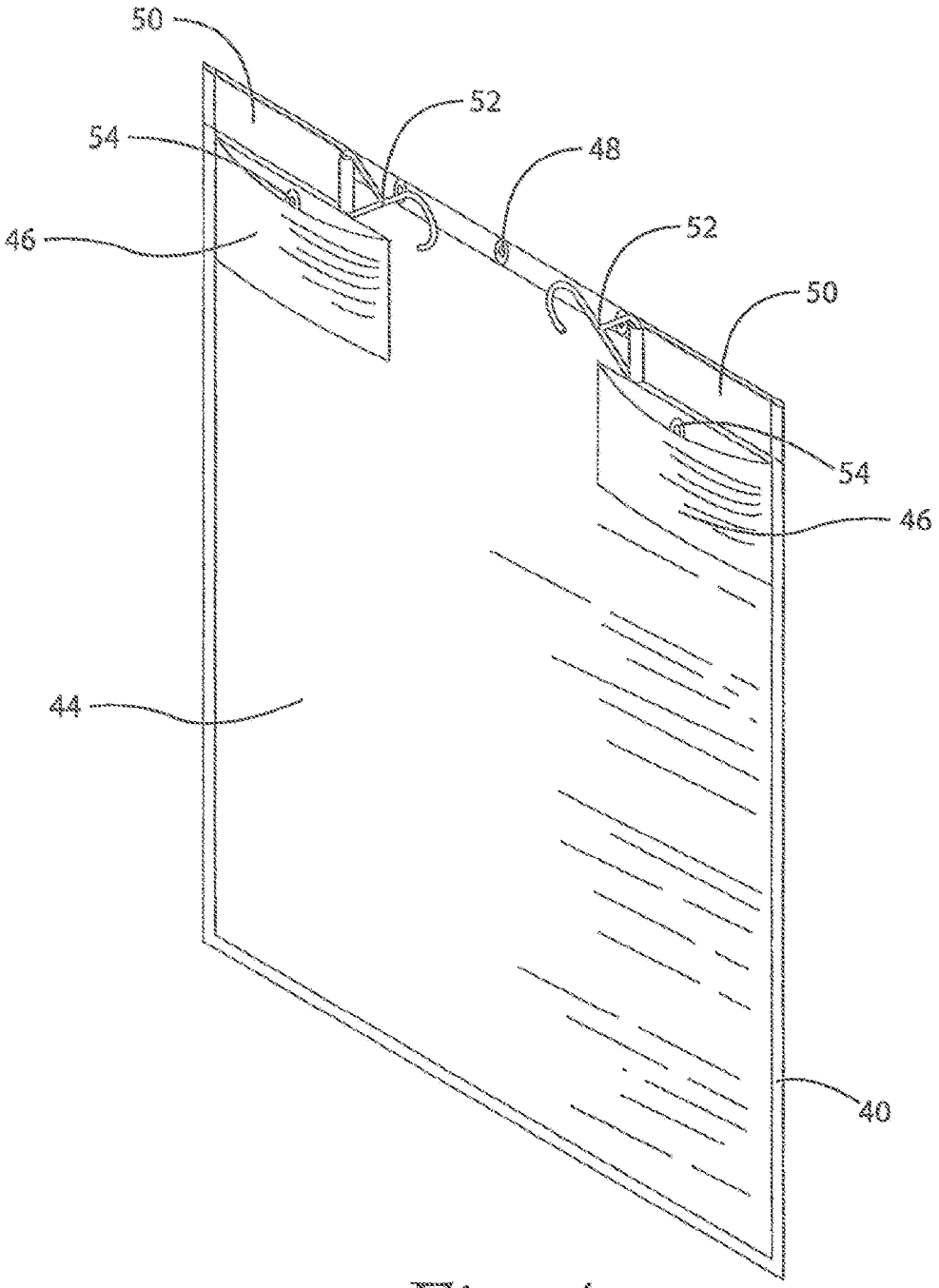
FIG. 4 is a front top right perspective view of an inside front surface 44 of the pocket 40 for an embodiment of the chair back cooler showing pouches 46, pouch buttons 54, hook straps 50, and hooks 52.
Figure 5:
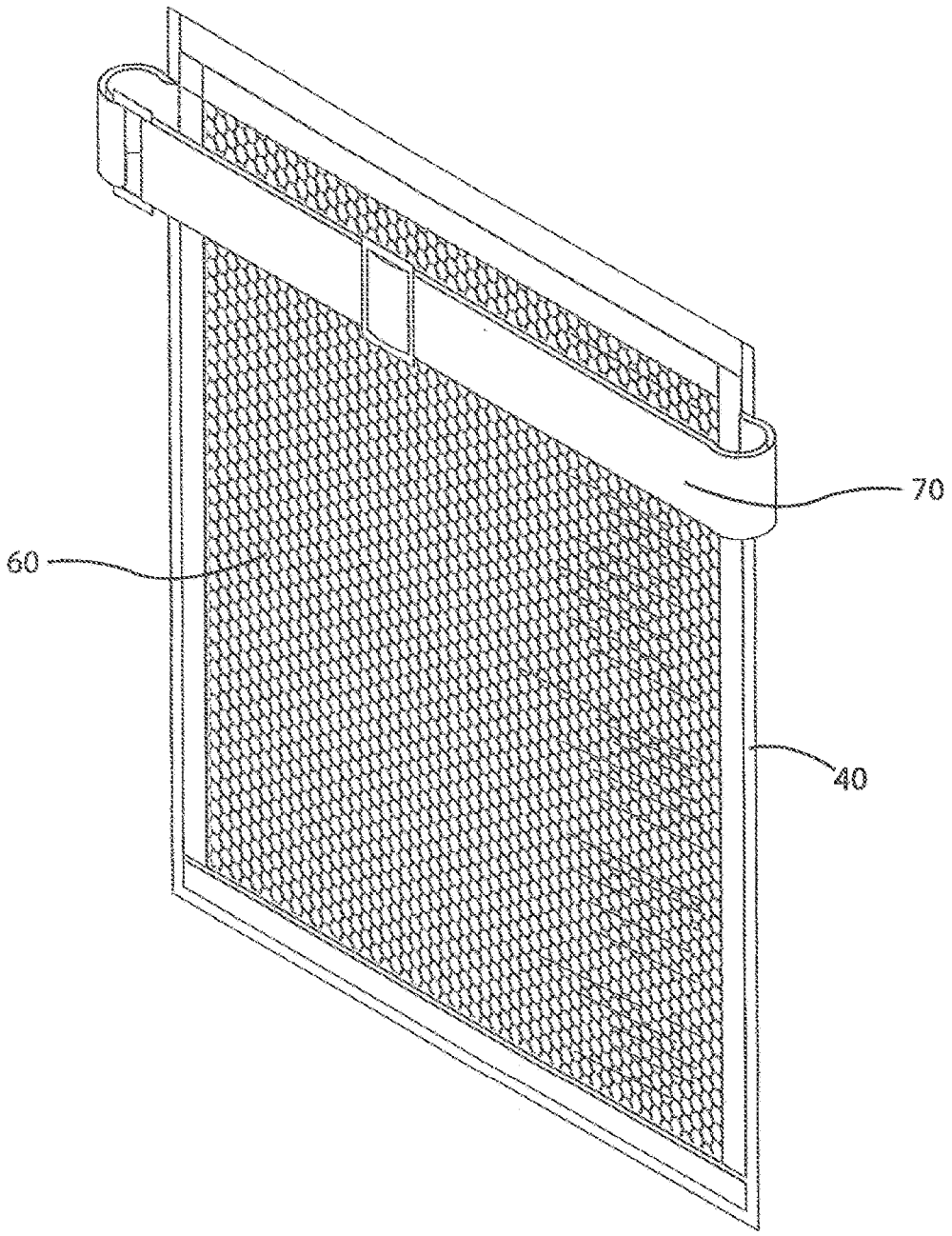
FIG. 5 is a rear top right perspective view of the exterior back surface 60 of the closed pocket 40 for an embodiment of the chair back cooler showing an adjustable belt 70.
Figure 6:
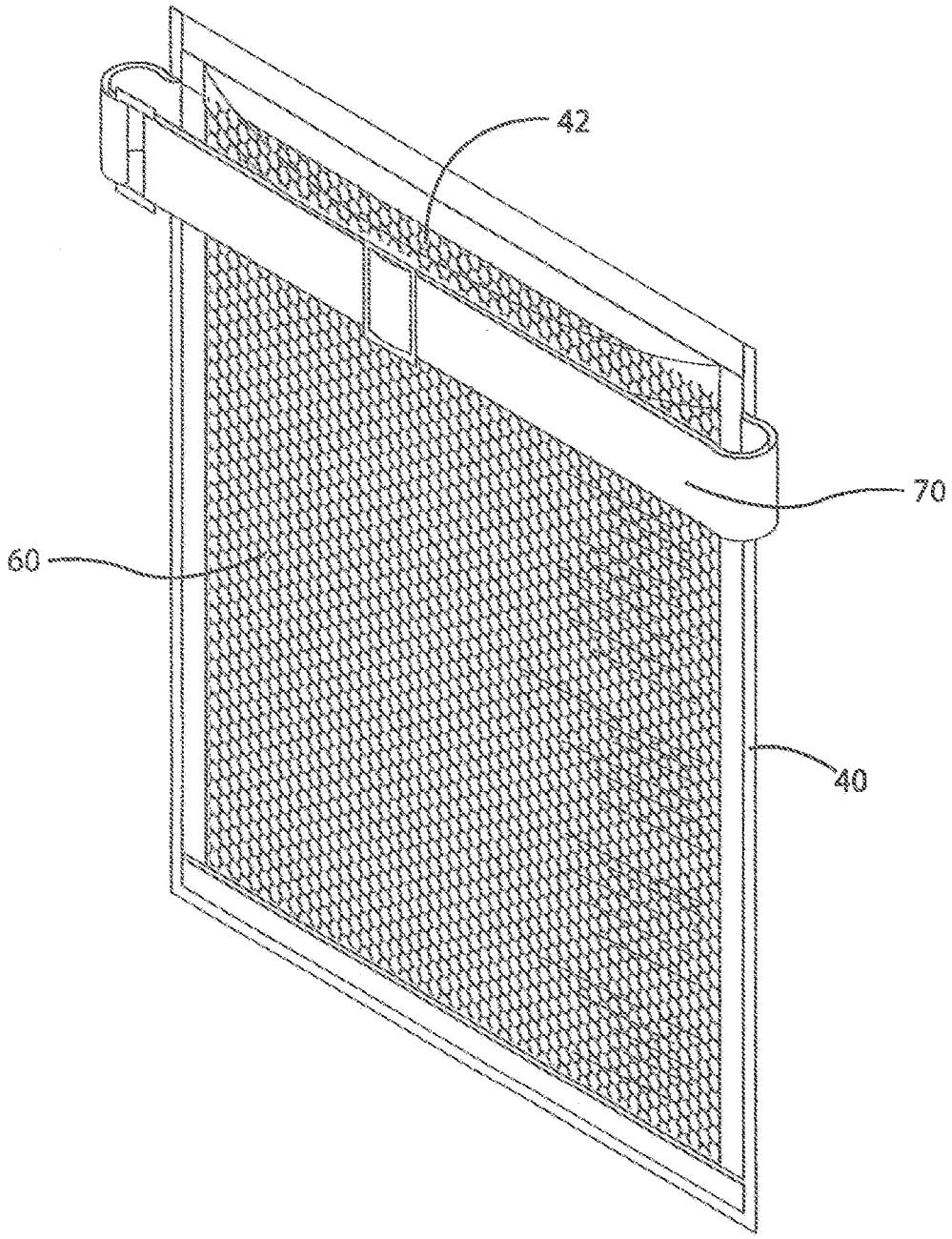
FIG. 6 is a rear top right perspective view of the of the exterior back surface 60 of the pocket 40 top open end 42 for an embodiment of the chair back cooler showing an adjustable belt 70.

An inside front surface 44 of the pocket 40 for an embodiment of the chair back cooler can include pouches 46, pouch buttons 54, hook straps 50, and hooks 52, FIG. 4. The exterior back surface 60 of the closed pocket 40 for an embodiment of the chair back cooler can include an adjustable belt 70, FIG. 5. horizontally disposed across the pocket back side 60, comprising two adjustable belt 70 ends, each adjustable belt 70 end is attached to top portion of the pocket 40 sides, and includes an adjustable belt 70 adjustment assembly positioned on the adjustable belt 70 between the two adjustable belt 70 ends. The adjustable belt 70 for an embodiment of the chair back cooler 10 can be stowed in the pocket 40 top open end 42 when not in use, FIG. 6.

Figure 7:
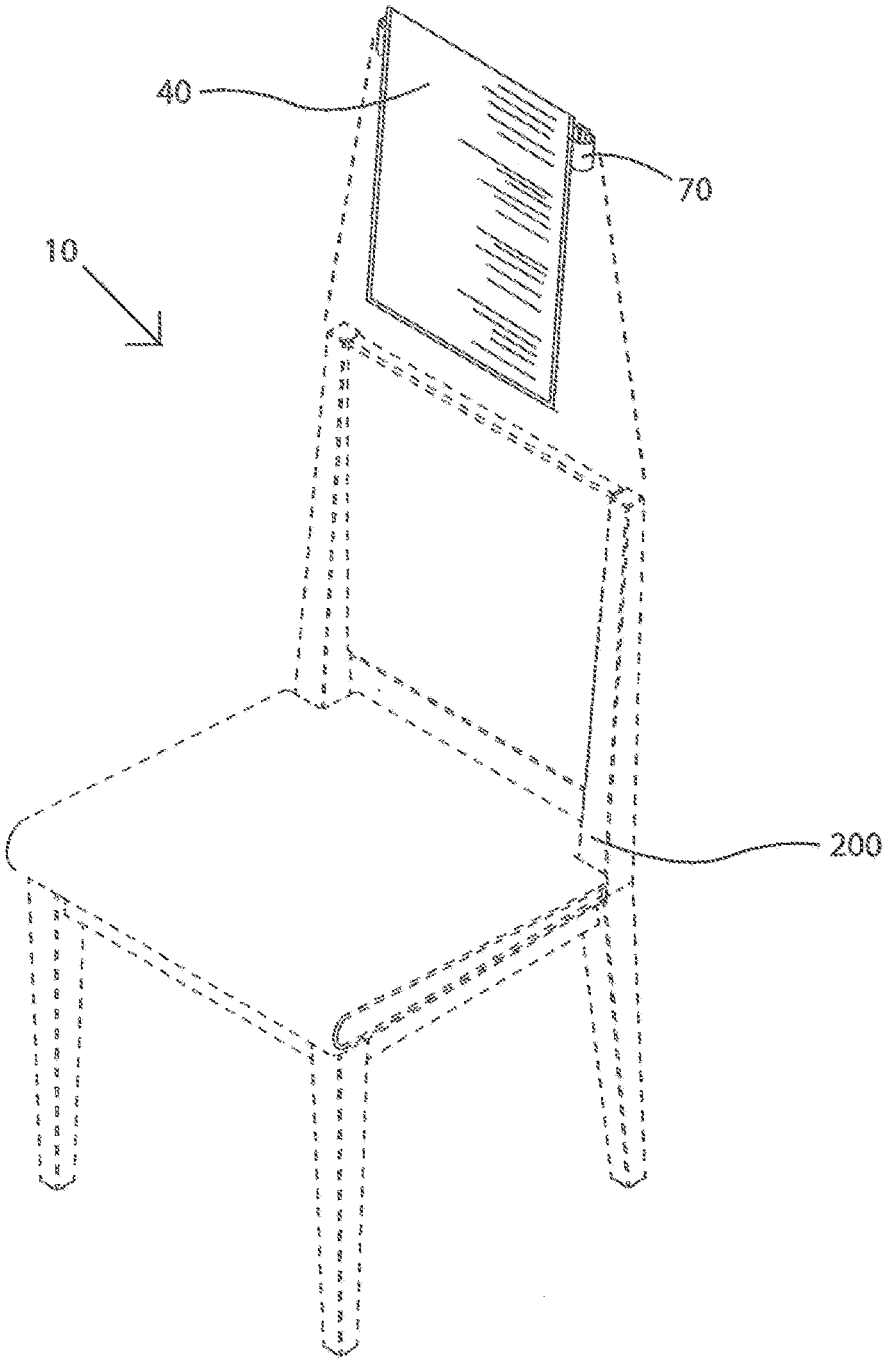
FIG. 7 is a front top right perspective view of an exterior front surface of the pocket 40 for an embodiment of the chair hack cooler 10 showing the adjustable belt 70 positioned to be received by a chair 200 back surface.

FIG. 7 is a front top right perspective view of an exterior front surface of the pocket 40 for an embodiment of the chair back cooler 10 showing the adjustable belt 70 positioned to be received by a chair 200 back surface.

Figure 8:
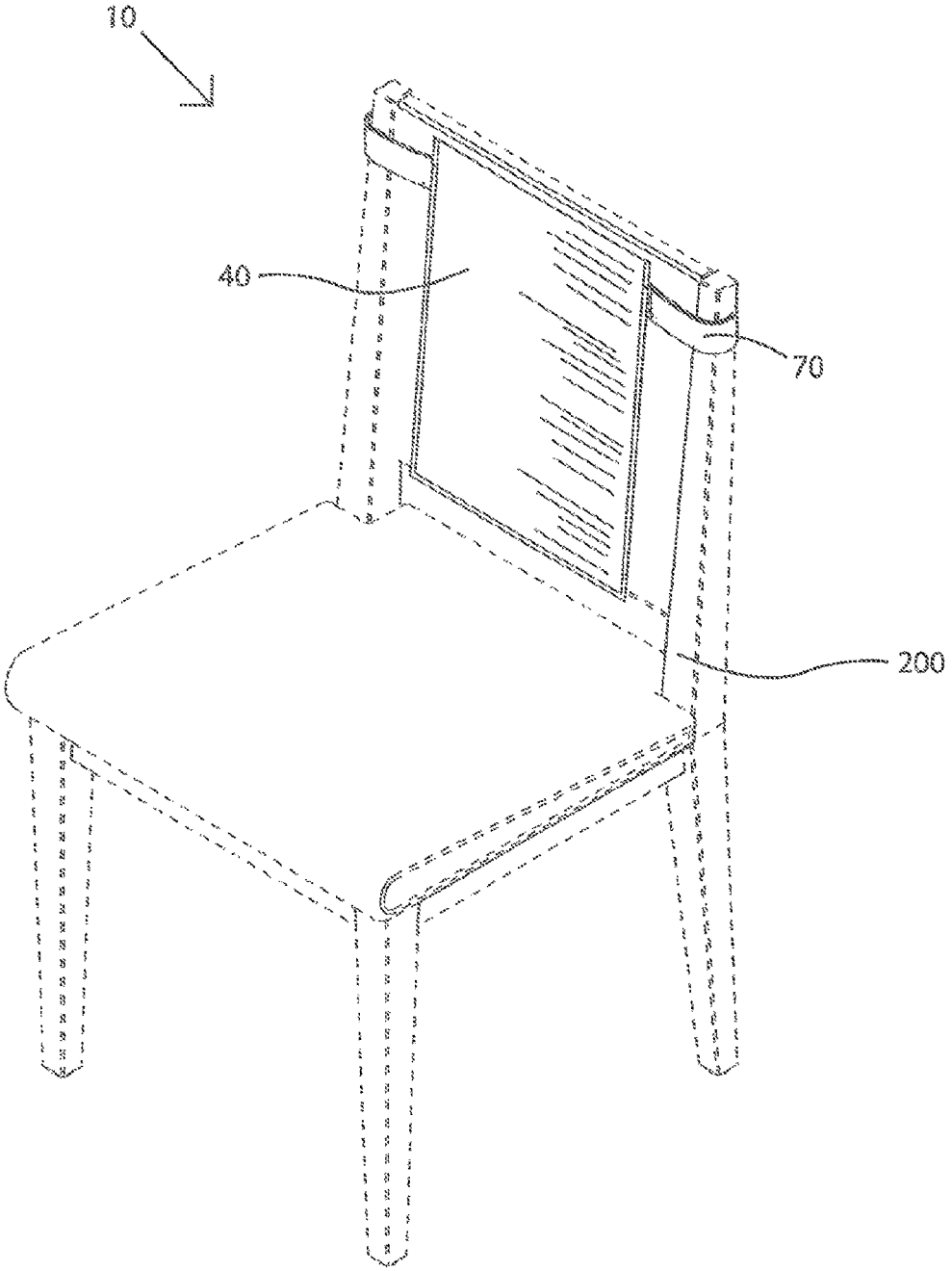
FIG. 8 is a front top right perspective view of an embodiment of the chair back cooler 10 showing the pocket 40 attached to a chair 200 back surface by the adjustable belt 70.

FIG. 8 is a front top right perspective view of an embodiment of the chair back cooler 10 showing the pocket 40 attached to a chair 200 back surface by the adjustable belt 70.

Figure 9:
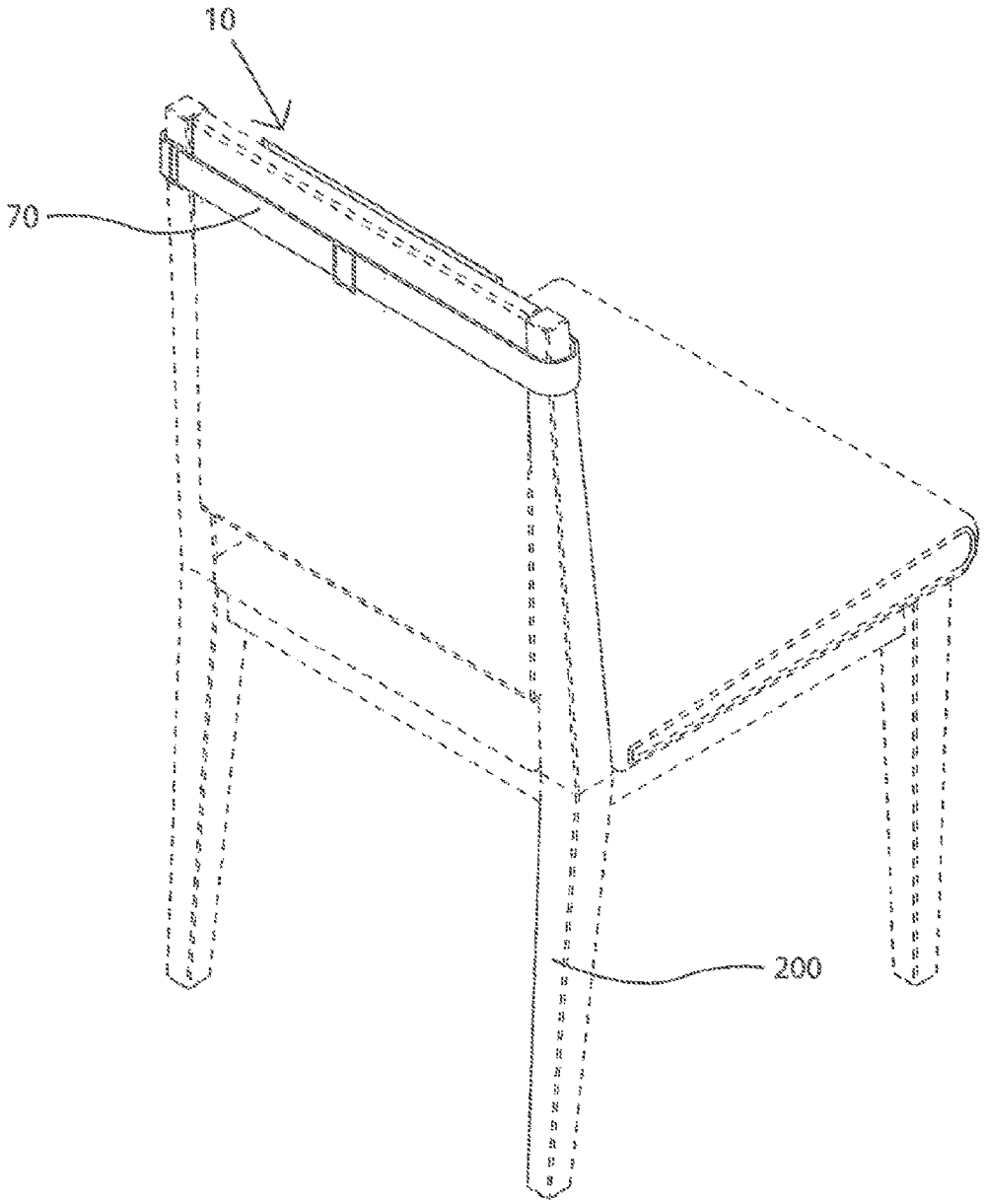
FIG. 9 is a rear top right perspective view of the closed pocket 40 of an embodiment of the chair back cooler 10 attached to a chair 200 back surface by the adjustable belt 70.

FIG. 9 is a rear top right perspective view of the closed pocket 40 of an embodiment of the chair back cooler 10 attached to a chair 200 back surface by the adjustable belt 70.

Figure 10:
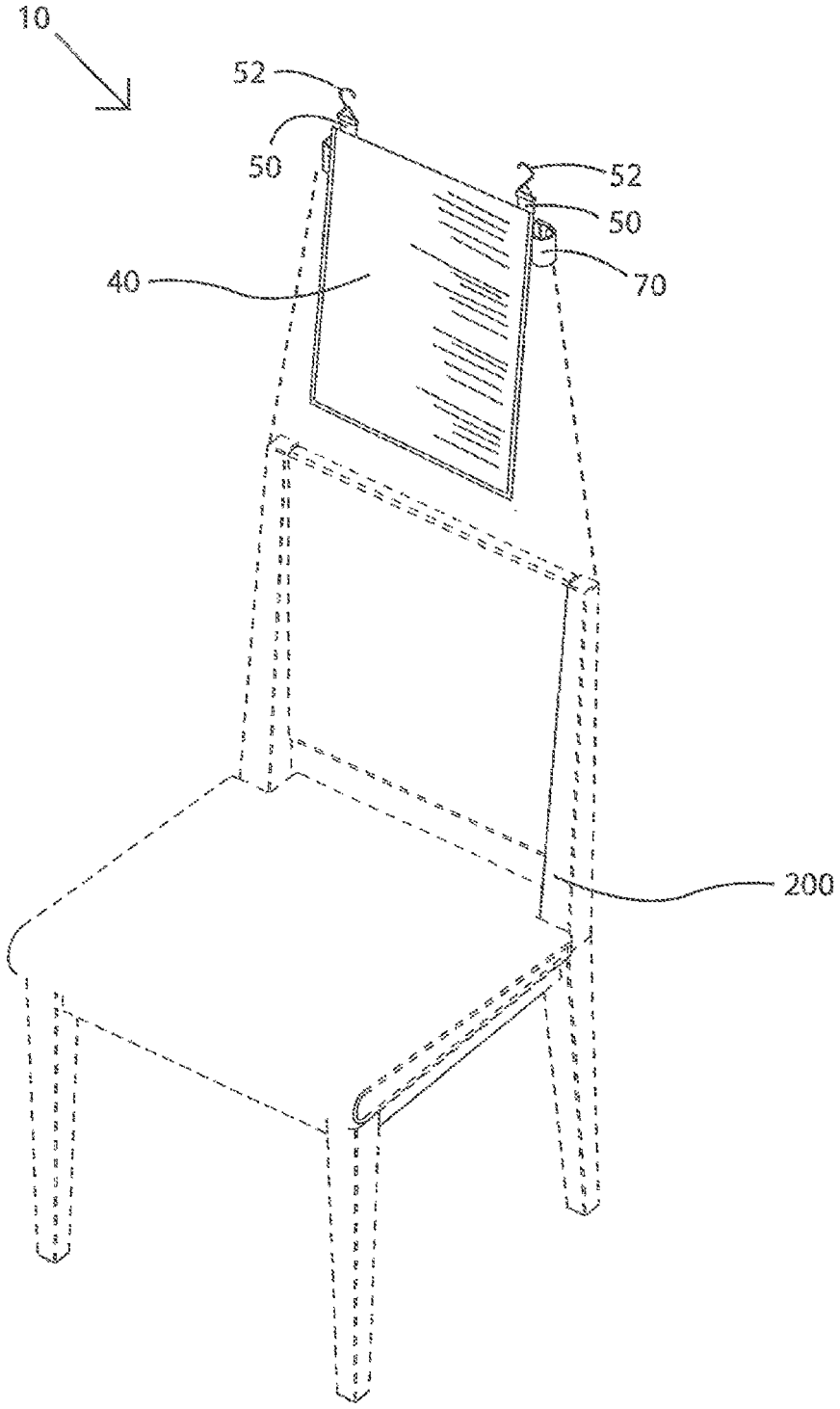
FIG. 10 is a front top right perspective view of an exterior front surface of the pocket 40 for an embodiment of the chair back cooler 10 showing the adjustable belt 70, hook straps 50, and hooks 52 positioned to be received by a chair 200 back surface.

FIG. 10 is a front top right perspective view of an exterior front surface of the pocket 40 for an embodiment of the chair back cooler 10 showing the adjustable belt 70, hook straps 50, and hooks 52 positioned to be received by a chair 200 back surface.

Figure 11:
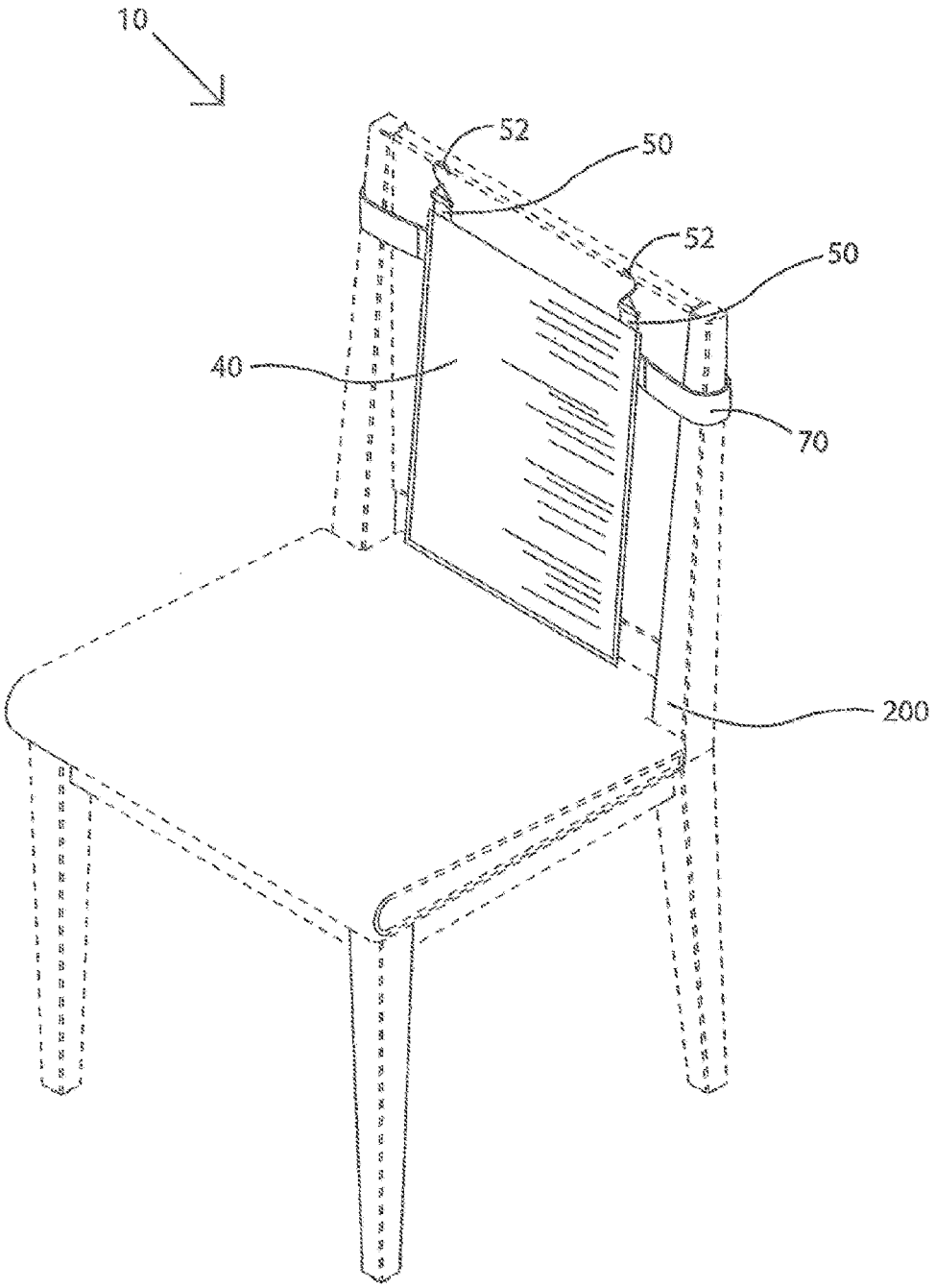
FIG. 11 is a front top right perspective view of an exterior front surface of the pocket 40 for an embodiment of the chair back cooler 10 attached to a chair 200 back surface by the adjustable belt 70, hook straps 50, and hooks 52.

FIG. 11 is a front top right perspective view of an exterior front surface of the pocket 40 for an embodiment of the chair back cooler 10 attached to a chair 200 back surface by the adjustable belt 70, hook straps 50, and hooks 52.

A portable seat back or chair back cooler that is adaptable to existing automobile seat backs as well as a wide range of chair backs is thus disclosed. The disclosed portable seat back or chair back cooler can be fitted onto an automobile seat back or a chair back to provide cooling comfort for a person sitting in the seat or chair without the requirements of any external cooling assembly or power. Finally, the portable seat or chair back cooler can be easily and inexpensively manufactured, and easily and safely used.

What is claimed is:

1. A portable seat back cooling apparatus adapted to attach to a chair back, comprising: an insert comprising an array of separate cooled gel packs on a front side of the insert and a plurality of attachment assemblies evenly disposed along a top portion of the insert; a pocket comprising sealed sides, a sealed bottom, an open top sized to receive and hold the insert in a vertical position and comprising a plurality of attachment assemblies evenly disposed along the open top and corresponding to the plurality of attachment assemblies evenly disposed along the top portion on the insert to engage and hold the insert in a vertical position within the pocket; pouches on a top left corner and a top right corner of an inside pocket surface, each pouch comprising a contained and extendable attachment assembly to adapt the pocket in a vertical position against a chair back; and a securing attachment attached to the pocket sides and horizontally disposed across an external pocket rear surface to secure the apparatus to the chair back and wherein the cooled gel packs inserted into the pocket provide a cooled pocket front surface when the apparatus is secured to a chair back.

2. The portable seat back cooling apparatus of claim 1, wherein the pocket sealed sides and sealed bottom further comprise hook and loop fasteners serving to allow the pocket sides and bottom to be unsealed and resealed.

3. The portable seat cooling apparatus of claim 1, wherein the pocket further comprises a mesh back side surface.

4. The portable seat cooling apparatus of claim 1, wherein the plurality of attachment assemblies evenly disposed along the open top and the corresponding plurality of attachment assemblies evenly disposed along a top portion on the insert array comprise hook and loop fasteners.

5. The portable seat cooling apparatus of claim 1, wherein the plurality of attachment assemblies evenly disposed along the open top and the corresponding plurality of attachment assemblies evenly disposed along a top portion on the insert array comprise button and button hole fasteners.

6. The portable seat cooling apparatus of claim 1, wherein the plurality of attachment assemblies evenly disposed along the open top and the corresponding plurality of attachment assemblies evenly disposed along a top portion on the insert array comprise metal and magnetic fasteners.

7. The portable seat cooling apparatus of claim 1, wherein each pouch contained and extendable attachment assembly to adapt the pocket in a vertical position against a chair back comprises an extendable hook strap attached to a hook, and each pouch further comprises a pouch closer button.

8. The portable seat cooling apparatus of claim 1, wherein the securing attachment attached to a pocket external rear surface to secure the apparatus to the seat comprises an adjustable belt horizontally disposed across the pocket back side, comprising two belt ends, each belt end attached to a top portion of the pocket sides, and further comprising a belt adjustment assembly positioned on the belt between the two belt ends.

9. A portable seat back cooling apparatus adapted to attach to a chair back, comprising:

a) an insert comprising an array of separate cooled gel packs on an insert front side and a plurality of attachment assemblies evenly disposed along a top portion of the insert;

b) a pocket comprising sealed sides, a sealed bottom, an open top sized to receive and hold the insert in a vertical position and comprising a plurality of attachment assemblies evenly disposed along the open top and corresponding to the plurality of attachment assemblies evenly disposed along a top portion on the insert to engage and hold the insert in a vertical position within the pocket;

c) a pouch on each top corner of an inside pocket surface, each pouch comprising an extendable hook strap attached to a hook to adapt the pocket in a vertical position with a pocket back surface flat against the chair back, and a pouch closer button; and d) an adjustable belt horizontally disposed across the pocket back side, comprising two belt ends, each belt end attached to a top portion of the pocket sides, and further comprising a belt adjustment assembly positioned on the belt between the two belt ends to secure the pocket back surface flat against the chair back;

wherein the cooled gel packs inserted into the pocket provide a cooled pocket front surface when the apparatus is secured to a chair back.

10. The portable seat cooling apparatus of claim 9, wherein the plurality of attachment assemblies evenly disposed along an open pocket top and the corresponding plurality of attachment assemblies evenly disposed along a top portion on the insert array comprise hook and loop fasteners.

11. The portable seat cooling apparatus of claim 9, wherein the plurality of attachment assemblies evenly disposed along an open pocket top and the corresponding plurality of attachment assemblies evenly disposed along a top portion on the insert array comprise button and button hole fasteners.

12. The portable seat cooling apparatus of claim 9, wherein the plurality of attachment assemblies evenly disposed along an open pocket top surface and the corresponding plurality of attachment assemblies evenly disposed along a top portion on the insert array comprise metal and magnetic fasteners.

13. The portable seat cooling apparatus of claim 9, wherein the pocket further comprises a mesh back side surface.

14. A portable seat back cooling apparatus adapted to attach to a seat back or chair back, comprising:

a) an insert comprising an array of separate cooled gel packs on an insert front side and a plurality of hook attachment assemblies evenly disposed along a top portion of the insert;

b) a pocket comprising sealed sides, a sealed bottom, an open top sized to receive and hold the insert in a vertical position and comprising a plurality of loop attachments evenly disposed along the open top and corresponding to the plurality of hook attachments evenly disposed along a top portion on the insert to engage and hold the insert in a vertical position within the pocket; c) a pouch on each top corner of an inside pocket surface, each pouch comprising an extendable hook strap attached to a hook to adapt the pocket in a vertical position with a pocket back surface flat against the chair back, and a pouch closer button; and d) an adjustable belt horizontally disposed across the pocket back side, comprising two belt ends, each belt end attached to a top portion of the pocket sides, and further comprising a belt adjustment assembly positioned on the belt between the two belt ends to secure the pocket back surface flat against the chair back;

wherein the cooled gel packs inserted into the pocket provide a cooled pocket front surface when the apparatus is secured to a seat back or a chair back.

15. The portable seat cooling apparatus of claim 14, wherein the pocket sealed sides and sealed bottom further comprise hook and loop fasteners to seal the sides and bottom.

16. The portable seat cooling apparatus of claim 14, wherein the pocket further comprises a mesh back side surface.

* * * * *